US006929166B2

(12) United States Patent
Furutsu

(10) Patent No.: US 6,929,166 B2
(45) Date of Patent: Aug. 16, 2005

(54) TAG ATTACHING DEVICE

(75) Inventor: Akira Furutsu, Lion's Station Plaza, 704, 20-12, Ryogoku 2-chome, Sumida-ku, Tokyo (JP)

(73) Assignees: Akira Furutsu, Tokyo (JP); Kotec's Co., Ltd., Tokyo (JP)

( * ) Notice: Subject to any disclaimer, the term of this patent is extended or adjusted under 35 U.S.C. 154(b) by 472 days.

(21) Appl. No.: 10/183,437

(22) Filed: Jun. 28, 2002

(65) Prior Publication Data

US 2004/0002716 A1 Jan. 1, 2004

(51) Int. Cl.[7] ..... B65C 7/00
(52) U.S. Cl. ..... 227/67
(58) Field of Search ..... 227/67, 71, 120, 227/138

(56) References Cited

U.S. PATENT DOCUMENTS 2,729,177 A * 1/1956 Flood ..... 112/104
3,896,713 A * 7/1975 Mato ..... 493/38
4,323,183 A * 4/1982 Duchin ..... 227/3
4,610,385 A * 9/1986 Duchin ..... 227/67
4,690,317 A * 9/1987 Hamisch, Jr. et al. ..... 227/67
4,718,590 A * 1/1988 Engelhardt ..... 227/67
4,838,469 A * 6/1989 Strausburg ..... 227/67
5,472,130 A * 12/1995 Beringhause et al. ..... 227/67
5,501,002 A * 3/1996 Fukami ..... 29/811.2

* cited by examiner

*Primary Examiner*—Scott A. Smith
(74) *Attorney, Agent, or Firm*—Young & Thompson

(57) ABSTRACT

A tag attaching device which can surely hold a tag hooked on a hollow needle projected from a front end portion of the tag attaching device. The device includes a main body 20, a gripping portion provided beneath the main body 20 and a lever 4 projected in front of the grip and swingably supported by the main body with a resilience force, and by driving the lever 4, a piston is moved forward via an internal mechanism so that a tag fastening element can be shot out. The device is characterized in that it provided with a tag holding member to tentatively hold a tag at a front of the main body.

11 Claims, 7 Drawing Sheets

TAG ATTACHING DEVICE

BACKGROUND OF THE INVENTION

1. Field of the Invention

The present invention relates to an improvement about a tag attaching device with which a tag such as a price tag, trademark tag, material explanation tag or the like can be attached to commodity goods such as garments, shoes, daily necessaries or household articles, via a tag fastening device (such as a tag pin) made of plastic or the like or a connecting device (such as a loop pin) made of plastic.

2. Description of the Related Art

A method for fastening A tag displaying a price, a name of maker producing a good, a material, a size or quality of a good for daily necessaries or household articles such as garments, bags, shoes or the like, by shooting a tag fastening device (tag pin or the like) made by plastic utilizing an tag attaching device, has been implemented as well as a connecting means comprising a filament, a male portion provided on one end portion of the filament and a female portion provided on another end portion thereof and the male portion and the female portion being connected to each other, has also been implemented, heretofore.

Each one of this kind of fastening device comprises a filament, a head portion provided on one end of the filament and a T-bar portion provided on another end thereof so as to have H-like configuration and a plurality of this fastening devices, for example, 100 to 200 devices, are arranged in parallelism to each other formed on a connecting bar as an assembly, and molded integrally by utility synthetic plastic.

And this fastening device assembly is used so that each one of the unit of the fastening devices is separated from this assembly one by one with the tag attaching device so that this fastening device assembly can be handled as one body from a molding process to the fastening device attaching process.

This kind of manually operated tag-attaching device is shown in FIG. 1 in Japanese Examined Utility Model Application No. 53-42077.

Note that as shown in FIG. 1 thereof, the tag attaching device has a similar configuration to a shot gun and it is provided with a lever projected in front of a grip and swingablely supported by the main body with a resilience forth, such as a spring means, and the tag fastening device assembly is mounted in a supply groove having a opening on an upper surface of a front portion of the main body and then by operating the lever, a piston portion provided inside of the main body is advanced forwardly with cooperation of an internal mechanism including such swing lever, a slider, a piston or the like in response to a movement of the lever, thereby one unit of the tag fastening device is separated from the tag fastening device assembly, from the most top end of the tag fastening device in the assembly and finally, the tag fastening device can be fastened with a tag on a commodity good such as a garment or the like in a way in that after the T-bar end thereof had been inserted into a hole provided at a rear portion of the hollow needle fixedly provided on a front portion of the main body, the T-bar end and a part of the filament are projected onto a space formed back side surface of the commodity good so that the tag fastening device can be fixed on the commodity good.

When a tag is to be attached to a commodity good by using such manually operated tag attaching devices the tag first is hooked on the hollow needle projected from a front portion of the main body via a hole provided on the tag, and then an operator grips a gripper portion of the main body thereof with his one hand simultaneously with holding the tag with forefinger of his same hand to grip the gripper so that the tag should not be fallen down from the needle while the operator supporting a portion of a good in the vicinity of a position to which the tag should be attached, and finally the operator attaches the tag to a good with shooting a tag holding means by operating the lever of the main body of the tag attaching device.

This kind of tag attaching device A is shown in FIG. 8 and as shown in the drawing, since this kind of device is provided with a tag shooting mechanism on upper front portion of the main body 1 having a shot gun like configuration, there exist a significant distance between a grip portion 2 provided at a lower portion of a rear part of the main body 1 and a hollow needle 3 provided at a front portion of the main body 1, and thus, an operator must generally drive the lever 4 for firing and releasing operations of the device by gripping the gripper 2 with his middle finger, ring finger, little finger and big fingers and extend his remaining forefinger forwardly to an upper front portion of the main body 1, so as to hold a lower portion of the tag T.

Of course, in a case of the operator being a male, who has a large hand with relatively long fingers, it can be easily carried out to hold the tag on a front portion of the main body 1 with the above-mentioned manner but in a case of the operator being a female who has relatively short fingers, it is seemed to be difficult.

In order to resolve this problem, a tag attaching device having a projected portion F projecting forwardly from the gripping portion 2 and provided on an upper portion of the main body 1, a length of which being shorter than that of a conventional one, has been discussed.

However, at present time, since the most of such devices which have been used world widely, do not have such designing, the tag attaching operation has been carried out in such a way that an operator has been attaching the tag T utilizing a tag attaching device by keeping a front portion of the device A in upper direction so that the tag T held on the hollow needle 3 provided on a front portion of the main body 1 via a hole provided on the tag T, should not be fallen down.

And thus, such operation raised a problem in that it was complicated and less efficiency.

As a tag attaching device, beside the device having a shot gun type configuration, as shown in FIG. 8, another tag attaching device (a loop pin gun) has been known and disclosed by the Japanese Unexamined Patent Publication No. 8-310520 and in that it is shown a device which can be adaptable in using a fastening means which comprising a filament, a male portion provided on one end of the filament and a female portion which can accept the male portion therein and provided on another end of the filament (as shown in the Japanese Unexamined Patent Publication No. 9-207962), so that the male portion and the female portion can be connected to each other to thereby cause the filament to formed a loop like configuration.

As shown in FIGS. 9 to 11, this kind of tag attaching device comprises a guide member 36 provided at a front end of the main body 30 and having a J-type configuration for guiding the female portion of the tag fastening means, a lever 33 swingably provided in front of the gripping portion 32, a hollow needle 34 provided at a front end of the main body 30 and an internal mechanism for forwarding each one of the tag fastening means one by one so as to connect the both end portion to each other.

As shown in FIG. 10, the female portion of the tag fastening means and a connecting bar are guided to a supply hole 35*a* while the male portion thereof is guided to a supply hole 35*b*, respectively, and by firing the lever 33, the female portion is guided to the most tip end portion of the J-typed guide member 31.

On the other hand, the male portion thereof is pushed out through the hollow needle 34 supported by an front end portion of a piston included in the internal mechanism with a timing that is delayed a little bit from the movement of the female portion and is mated with the female portion held at the tip end portion of the guide member 36 so as to cause the filament to make a looped form.

As shown in FIG. 10, since this tag-attaching device has a short hollow needle 34 while an overall body size is large, if when a tag is simply hooked on the needle, it is easily fallen down.

Therefore, it is necessary for an operator to hold the tag T with his finger of his hand gripping the tag attaching device but this operation is more difficult one comparing with the aforementioned attaching device and extremely impossible for the operator to do so.

Therefore, a problem in that an operational ability of this device is inefficient had been raised.

Accordingly, it is an object of the present invention to provide a tag attaching device which can easily and surely hold a tag on a hollow needle of or on a front portion of a main body of the device for shooting either one of the fastening means such as a tag pin type fastening means as shown in FIG. 8 or a loop pin type fastening means as shown in FIG. 9, and which enable for an operator to perform the tag attaching operation freely with keeping the device in any direction, for example, in down-ward direction.

SUMMARY OF THE INVENTION

In order to achieve the above-noted object, the present invention adopts the following basic technical constitution.

Specifically, a first aspect of a tag attaching device of the present invention, comprises a main body, a grip portion extending downwardly from the main body and a lever projected in front of the grip and swingablely supported by the main body with a resilience forth, an internal mechanism enabling to drive a piston portion in response to a movement of the lever and a hollow needle provided at a front portion of the main body and being provided in front of the piston portion, so that a tag fastening means can be shot out in accordance with a movement of the lever, wherein the tag attaching device being provided with a tag holding means to tentatively hold a tag at a front of the main body.

In the present invention, the tag fastening means is either one of a fastening device comprising a filament, a head portion provided at one end of the filament and a T-bar portion provided at another end thereof so as to form a H-type configuration, at least the T-bar portion being penetrated into a commodity good so as to fix a tag supported by the filament on the commodity good, and a connecting device comprising a filament, a female portion provided at one end of the filament and a male portion provided at another end thereof, the filament which is supporting a tag thereon, being penetrated through a commodity good thereafter the male portion and the female portion being connected to each other so that the filament being formed into a looped configuration with holding the tag on the filament.

Further, in the present invention, the tag holding means being displaceable so as to take a tag holding position and a tag receiving position and the tag attaching device is rotatably provided at a front portion of the main body.

Moreover, in the present invention, the tag-attaching device is preferably configured so that it can optionally stay at either one of positions with utilizing a spring member. In a specific embodiment of the present invention, the tag attaching device comprises a first arm and a second arm each being pivotably supported on a side surface of a front portion of the main body and a front plate connecting the first and second arms and which being positioned in front of the front portion of the main body, the tag attaching device being configured so that when the tag attaching device being in a tag holding position, the tag being held between the front plate and a front portion of the main body so that the tag not being drop out.

In addition to the above-mentioned, the tag holding means of a tag attaching device of the present invention is configured so as to be selectively disposed at either one of positions consisting a tag holding position and a tag receiving position by a connection between a spring means provided on a side surface of the main body and a cam portion provided on the second arm.

It is noted that in the present invention, a tag should be supported by the hollow needle through a hole provided on the tag, before it is shot by the tag attaching device.

Further in the present invention, the tag holding means in the tag attaching device is configured so that when the tag is withdrawn from the hollow needle, the front plate is automatically lifted up by a movement of the tag causing the tag holding means to be set at the tag receiving position.

Moreover, in the present invention, the tag holding means is configured so that when the tag is hanged on the hollow needle through the hole provided on the tag during the front plate of the tag holding means being set at the tag receiving position, the tag pushing the second arm so as return the tag holding means to the tag holding position.

In the tag attaching device of the present invention, the tag holding means is configured so as to be selectively disposed at either one of positions consisting a tag holding position and a tag receiving position by a connection between a spring means provided on a side surface of the main body and a cam portion provided on the second arm, and the tag holding means being controlled so that when the tag is withdrawn from the hollow needle, the front plate is pressured by a movement of the tag thereby the tag holding means being raised up to the tag receiving position, while the tag holding means being set at the tag holding position by operating the second arm.

In addition to the above-mentioned, the tag holding means comprising the first and second arms and the front plate further provided with a spring means so as to return the tag holding means from the tag receiving position to the tag holding position, automatically.

A tag attaching device of the present invention, the tag holding means being disposed on a position in the vicinity of the hollow needle provided on a front end portion of the main body, the tag holding means having elasticity, wherein the tag holding means being configured so that the tag is inserted into the front portion of the main body whereby the tag being hooked on the hollow needle via a hole provided on the tag, during the tag holding means being deformed, so as to hold the tag by the tag holding means, and further wherein when the tag fastening device is about to be removed from a commodity good and the tag attaching device, the tag is withdrawn from the tag attaching device with the tag deforming the tag holding means.

DESCRIPTION OF THE PREFERRED EMBODIMENTS

The preferred embodiments of the present invention will be described hereunder with reference to the attached drawings.

EXAMPLE 1

FIGS. 1 to 4 are drawings showing a left side view, a front view, a plan view and a right side view of a main body of a tag attaching device of the present invention utilizing an automatic tag holding means, respectively.

As shown in these figures, a tag holding means 21 is pivotally provided on a front portion of the main body 20 of the tag attaching device C, by mating two projecting portions 21*a* provided on the tag holding means 21 with each one of two respective recessed portions 20*a* each being provided on each sides of the front portion of the main body 20, respectively so that the tag holding means 21 can be swung upwardly and downwardly.

The tag holding means 21 comprises a first arm 21*b*, a front plate 21*c* and a second arm 21*d* and it is integrally formed into one body with synthetic plastic so as to have two legs each being extended from the front plate 21*c* in parallelism with each other.

The second arm 21*d* of the tag holding means 21 serving as a portion to control the tag holding means 21 to be raised up or to be fallen down and the front plate 21*c* thereof is positioned at a front edge portion of the main body 20 while the second arm 21*d* locates on a right hand side surface of the main body 20 and the first arm 21*b* locates on a left hand side surface of the main body 20 so that the tag holding means 21 can ride on a front end portion of the main body 20 of the tag attaching device C.

Figure 4:
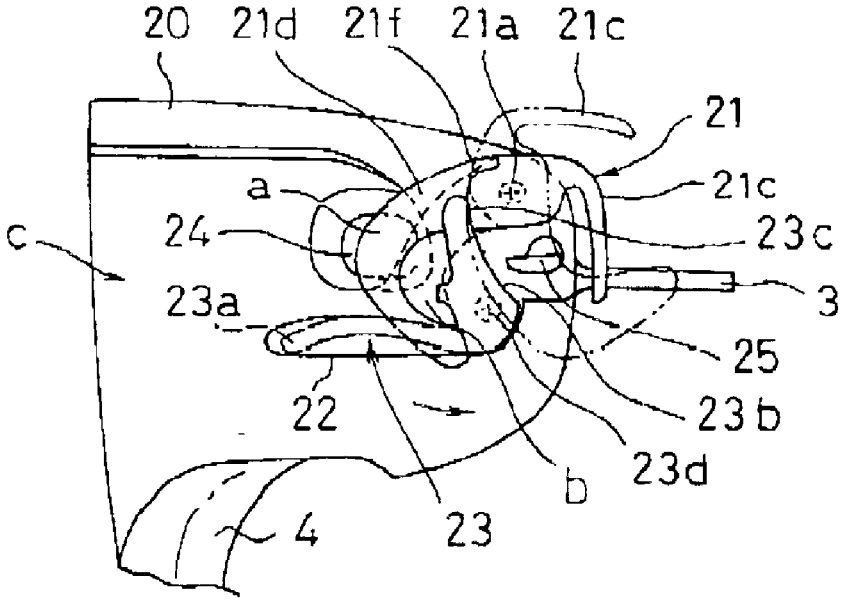
FIG. 4 is a drawing showing a left side view of the tag attaching device as shown in FIG. 1.

As shown in FIG. 4, the second arm 21*d* is provided with a projected portion, a cross-sectional configuration of which showing a peak point at a center portion thereof so as to illustrate a mountain like configuration, and when a pushing surface having a sloped portion a of the projected portion is pushed with a finger of an operator so as to be moved forwardly, the tag holding means 21 is rotated with respect to the projected portions 21*a* as a rotation center, as shown with a arrow so that the front plate 21*c* is went up as shown by a dotted line, causing the front plate 21*c* to set at a position in which the plate 21*c* to be in parallelism with a hollow needle 3 so as to form an opening portion to accept for a tag thereunto.

And simultaneously with this, a lower half portion of the second arm 21*d* is projected from the front edge portion of the main body 20 as shown by a dotted line so as to create a tag receiving condition.

As mentioned above, when a tag is attached to a good, the second arm 21*d* as projected in front of the front end portion of the main body 20 is pushed backwardly by the tag to be attached so that the condition of the tag holding means is changed so as to create a tag holding condition.

Or, shown with a dotted line, when an operator contacts his finger with a withdrawal surface b provided on a position opposite to the above-mentioned pushing surface a with respect to the peak point of the second arm 21*d* which had been pushed out in front of the main body, the tag holding means 21 can be returned to a tag holding condition as shown by a solid line.

Further, a grooved portion 22 is formed on a right hand side surface of the front end portion of the main body 20, a spring means 23 made by synthetic plastic and having a dove like configuration, is inserted thereunto.

This spring means 23 comprises a spring portion 23*a* extending along a front to back direction of the main body 20, an active portion 23*b* raising upwardly, a contacting member 23*c* provided at a top end portion of the active portion 23*b* and a projecting portion 23*d* serving as a rotation axis.

In addition, a knob portion 24 is further provided for moving a free lever backwardly so as to remove the tag fastening device assembly from the tag attaching device C and 25 denotes a locking member so as to fix the hollow needle.

The second arm 21*d* is provided with a cam portion 21*f* on a back surface of the second arm 21*d*, and in the vicinity of a position on which the projecting portion 21*a* serving as a rotation center is formed.

When this tag holding means 21 is rotated to a condition as shown by a dotted line, the contacting member 23*c* provided at a top end portion of the active portion 23*b* is contacted with the cam portion 21*f* so that the spring portion 23*a* gives a biased resilience force to the tag holding means so as to keep the tag holding means 21 at its current position.

Next, an operating method for operating the tag attaching device of the present invention.

Figure 3:
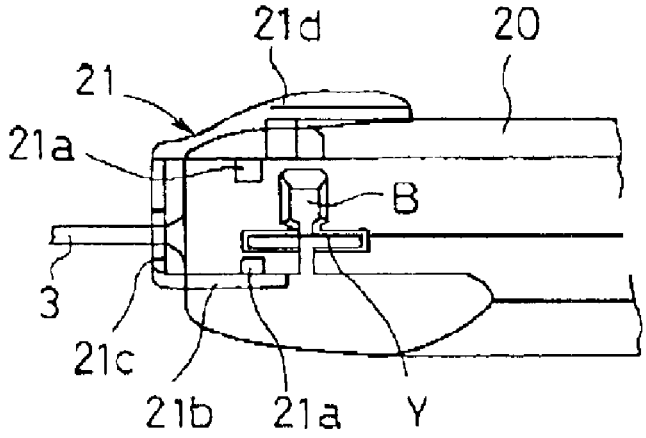
FIG. 3 is drawing illustrating a plan view of the tag-attaching device as shown in FIG. 1.

A Preparation for Shooting a Tag Fastening Means:

As shown in FIG. 3, the connecting bar of the tag fastening device assembly is inserted into a supply hole B while the T-end portions are inserted into a separate supply hole Y so as to make a preparation for shooting the tag fastening devices.

Figure 1:
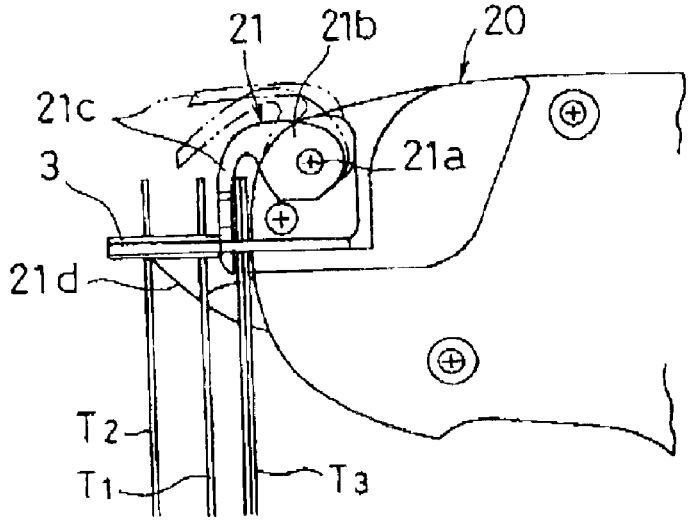
FIG. 1 is drawing illustrating a left side view of a main body of a first embodiment of the tag attaching device of the present invention.
Figure 2:
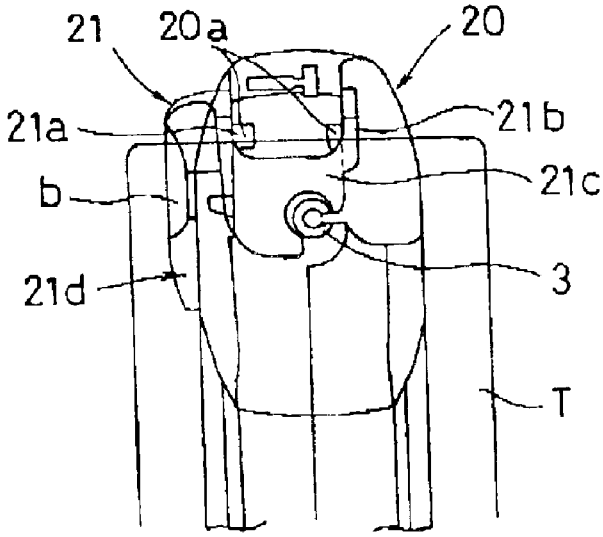
FIG. 2 is a drawing showing a front view of the tag-attaching device as shown in FIG. 1.

A Rotation of the Tag Holding Means:

As shown in FIGS. 1 and 4, when the pushing surface a of the second arm 21*d* of the tag holding means 21 staying in the tag holding condition as shown by the solid line, is pushed to be moved forwardly, the tag holding means 21 is rotated as shown by an arrow to be moved into a condition as shown by the dotted line and as mentioned above, the contacting member 23*c* of the spring 23 and the cam portion 21*f* of the tag holding means 21 are contacted with each other so that the tag holding means 21 can be held at a condition as shown by the dotted line.

A Holding Operation of a Tag:

Next, as shown in FIG. 1, when a tag T is Inserted into a hollow needle 3 via a hole provided on the tag T and the tag T is pushed toward the front end portion of the main body 20, a portion having a L-type configuration of the second arm 21*d*, is pushed backwardly by the tag T, so that the tag holding means 21 is changed from its current condition such as tag receiving condition as shown in FIG. 4 by the dotted line to the tag holding condition as shown by the solid line.

When the tag holding means 21 is mutually changed between two different conditions, since the active portion 23*b* of the spring member 23 is received a resilience force by the spring member 23*a* and thus the tag holding means 21 is changed its position under a pressure caused by the spring means 23 so that the tag holding means can hold the tag between the front end portion of the main body 20 and the front plate 21*c*.

Attaching Operation of a Tag:

Next, the hollow needle 3 provided on the front end portion of the tag attaching device C is penetrated into a commodity good such as a garment or the like and then the lever 4 provided in the gripping portion 2 is fired.

Then, a T-end portion of one piece of unit of the tag fastening device, can be projected on a back surface of the commodity good such as a garment or the like through the hollow needle 3.

After that, when the hollow needle 3 is withdrawn from the good by moving the tag attaching device C backwardly, a tag is pulled by a head portion of the tag fastening device so as to be moved from a position T to a position T2 and finally, the tag is withdrawn from the device and attached on the good via the tag fastening means.

An Operation of the Tag Holding Means:

After the tag t had been attached to the good, with the movement of the tag T being withdrawn from the tip end portion of the hollow needle 3, the tag T causes to raise up the front plate 21*c* provided on the front end portion of the tag attaching device C is raised up, resulting the contacting member 23*c* of the active portion 23*b* of the spring member 23 to be resiliently contacted with the cam portion 21*f* formed on a back surface of the second arm 21*d*.

With accompanied by this operation, the tag holding means 21 is rotated so as to put the tag holding means 21 into a tag receiving condition.

At a first stage of the tag attaching operation, the tag holding means 21 is raised up so that the tag holding means 21 is changed its condition from the tag holding condition as shown in FIGS. 1 and 4, by the solid line, to the tag receiving condition as shown by the dotted line so as to make a preparation for receiving a tag T.

And further, as shown in FIG. 1, the tag T is pushed toward the front portion of the main body 20 of the tag attaching device C through the hollow needle 3, from a position T2 to T1 and further the pushing operation should be continued so that the tag should be placed at a position T3 thereby the tag holding means 21 being automatically rotated so as to enable to hold the tag T.

After that, at every time when each one of an unit of the tag fastening device is shot, the tag holding means 21 takes the tag receiving condition such as an opening condition, and when the tag T is pushed toward the front end of the main body 20, the tag holding means is changed its condition to the tag holding condition by the resilient force generated by the spring means so as to enable to hold the tag T in front of the tag attaching device.

When the tag holding means is set at the tag holding condition, the tag T no longer has a chance to be naturally fallen down from the hollow needle 3, and thus, even when the tag attaching device is faced to a down ward direction, or even when the tag T is forced to be moved in contacting with a good, the tag T is still kept in a front portion of the tag attaching device without being fallen down therefrom resulting the tag attaching operation in quite easy.

EXAMPLE 2

Figure 5:
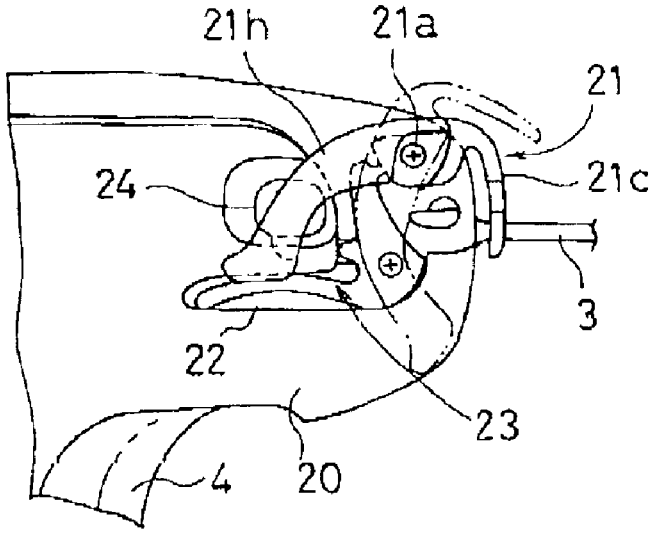
FIG. 5 is drawing illustrating a right side view of a main body of a second embodiment of the tag-attaching device of the present invention.

FIG. 5 shows a tag attaching device of the present invention, in that the tag T is held at a front portion of the device with manually, is shown.

In FIG. 4, although the second arm 21*d* of the tag holding means 21 has a L-typed configuration, a second arm 21*h* of the tag holding means 21 of this embodiment has a J-typed configuration.

And in this embodiment, when the tag fastening means has been shot into a commodity good so that the tag holding means 21 is raised upwardly, and even after when the tag T had been withdrawn from the front end of the tag attaching device, the second arm 21*h* is still remained inside of outer peripheral contour of the main body 20, as shown by the dotted line.

In a tag T receiving operation, the second arm 21*h* is pushed forwardly, so as to rotate the tag holding means 21 causing it to be in upright condition as shown by the dotted line in FIG. 5, and then one or plurality of the tags T are hooked on the hollow needle 3 followed by an operation for returning the tag holding means to a position as shown by the solid line to keep the tags T at its position.

Note that, the holding force of the tag holding means 21 to hold the Lay T its generated in the similar way as the one shown in FIG. 4, in which it is generated by contacting the spring 23 with the cam 21*f*.

In performing the tag attaching operation, the front plate 21*c* of the tag holding means 21 is rotated by a movement of the tag therefrom, to a position as shown by the dotted line, so that the tag holding means is set at the tag receiving condition.

EXAMPLE 3

Figure 6:
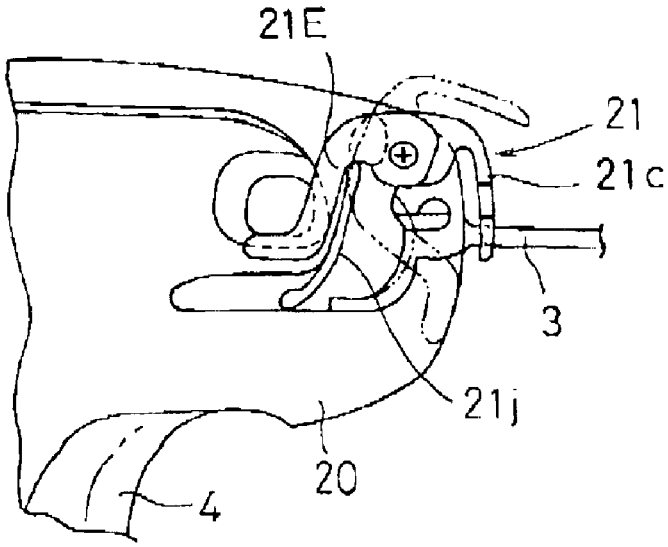
FIG. 6 is drawing illustrating a right side view of a main body of a third embodiment of the tag attaching device of the present invention.

FIG. 6 shows a tag-attaching device, which can hold a tag T at a front-end portion of the device.

Note that in this embodiment, a spring member 23 as shown in FIG. 4 is omitted.

In this embodiment, a small spring 21*j* is provided so as to be adjacently arranged to a second arm 21E and in parallelism therewith, instead of the above-mentioned spring member 23 and thus when the second arm is pushed forwardly with a finger of an operator so as to realize the tag receiving condition as shown by a dotted line.

Then, a tag T is hooked on the hollow needle 3 via a hole provided in the tag T, and thereafter, when the force as applied by a finger to the second arm 21E, is released, the tag holding means 21 will be returned to the position as shown by the solid line.

Thereafter, the tag T is held between the front-end portion 21 of the main portion 20 and the front plane 21*c*.

After that, by doing the above-mentioned tag attaching operation, the tag T is held on the hollow needle 3 and under this condition, in response to the tag attaching operation in that the tag fastening means is shot into a good, the front plate 21*c* is raised upwardly, so that the front plate releases the tag T so as to enable a tag T to be attached on a good.

EXAMPLE 4

Figure 7:
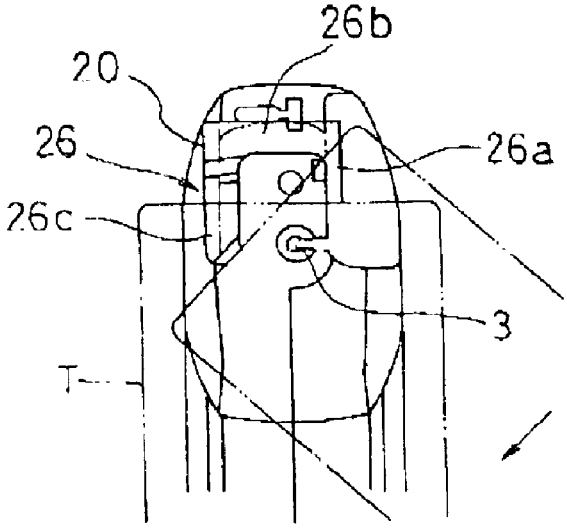
FIG. 7 is drawing illustrating a front view of a main body of a fourth embodiment of the tag attaching device of the present invention.
Figure 8:
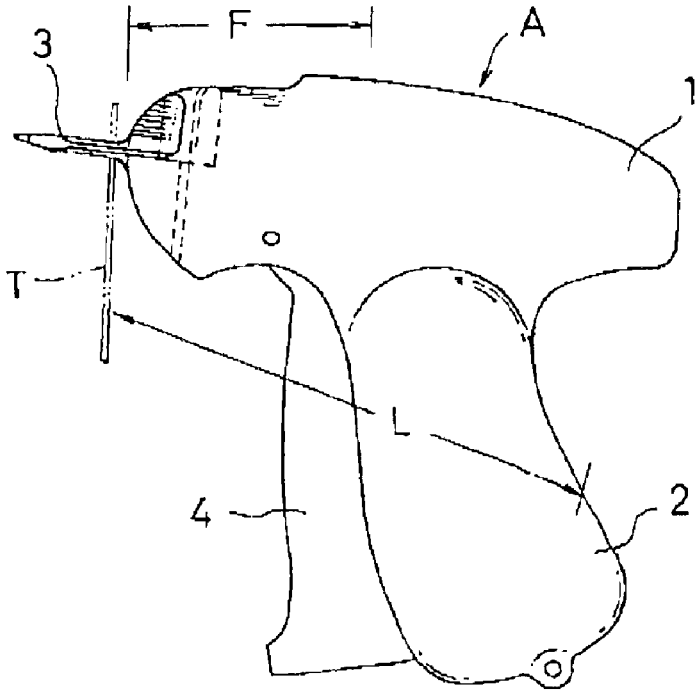
FIG. 8 is a drawing showing a left side view of a conventional tag-attaching device.

FIG. 7 shows a front view of a tag attaching device used in this embodiment, which is provided with a tag holding means controlled by a fixed spring.

In this embodiment, the tag attaching device is provided with a tag holding means 26, which comprising a fixed side 26*a* to be fixed to the main body 20, a transverse side 26*b* with perpendicularly extended from an end portion of the fixed side 26*a* and across over the front end portion of the main body 20 and an engaging side 26*c* having a thin flat configuration and which is extended from the transverse side 26*b* slightly into a forward direction with having a step like configuration and further extended downwardly therefrom, so as to serve as a spring means.

And as shown in FIG. 7, the tag T is contacted with the hollow needle 3 with some inclination with respect to the needle 3, for example, a left hand side inclination or the like, and then the tag T is rotated along an arrow so that a portion of the tag T is inserted into position formed between the front end portion of the main body 20 and a back side surface of the engaging side 26*c* thereby the tag T can be held therebetween.

After doing this, as mentioned above, the tag fastening means is shot into a garment or the like, and then when the tag attaching device is removed from the garment or the like thereby the tag T is withdrawn by the tag fastening means, the engaging side 26*c* can be deformed with its resilient and flexibility so that the tag T can be naturally removed from the needle.

In this embodiment, the next tag T should be held in front of the front portion of the device with a manual operation.

EXAMPLE 5

FIGS. 9 to 14 show an improvement of a tag attaching device as shown in the Japanese Unexamined Patent Publication No. 8-310520, which having a mechanism for attaching a tag T as shown in the Japanese Unexamined Patent Publication No. 9-207962, in that a filament portion is formed into a loop-like configuration by connecting the connecting members each being provided at both ends of the filament, respectively (a loop pin typed tag fastening means).

Figure 9:
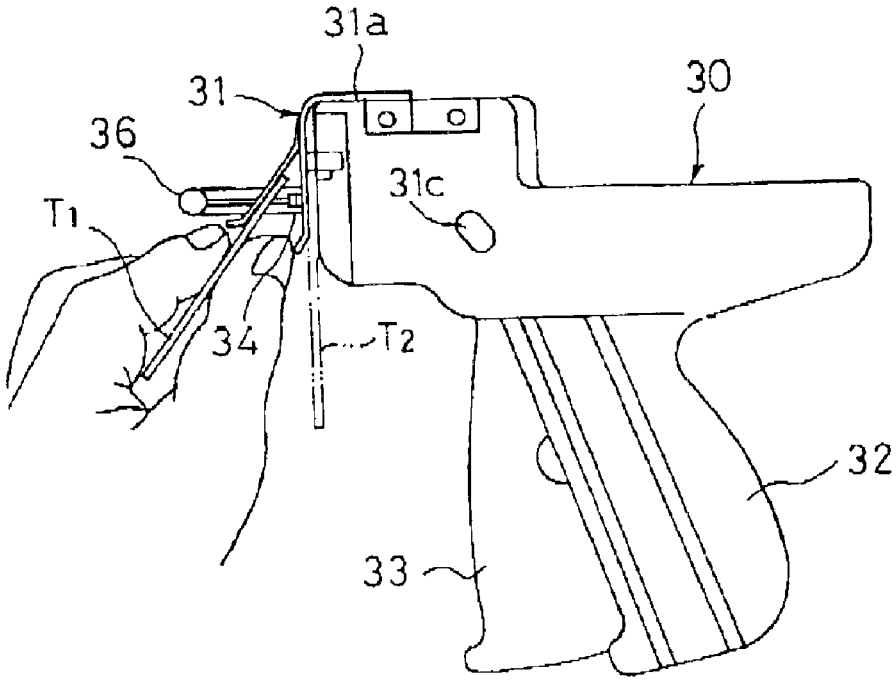
FIG. 9 is drawing illustrating a left side view of a conventional the tag attaching device used for shooting a tag fastening means of loop pin type.
Figure 12:
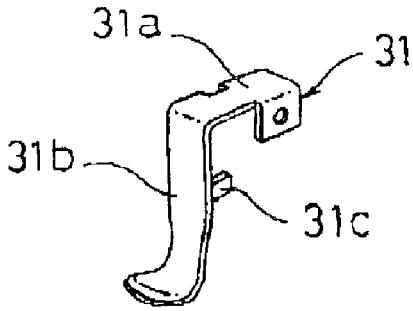
FIG. 12 is a drawing showing a perspective view of a tag holding means used in the tag attaching device of the present invention.
Figure 13:
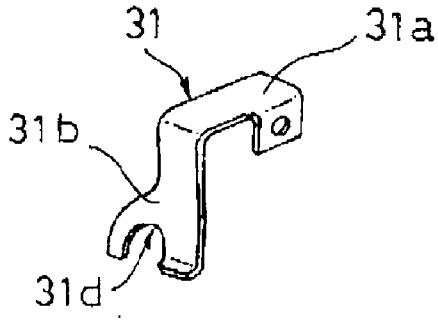
FIG. 13 is a drawing showing a perspective view of a separate tag holding means of the present.
Figure 14:
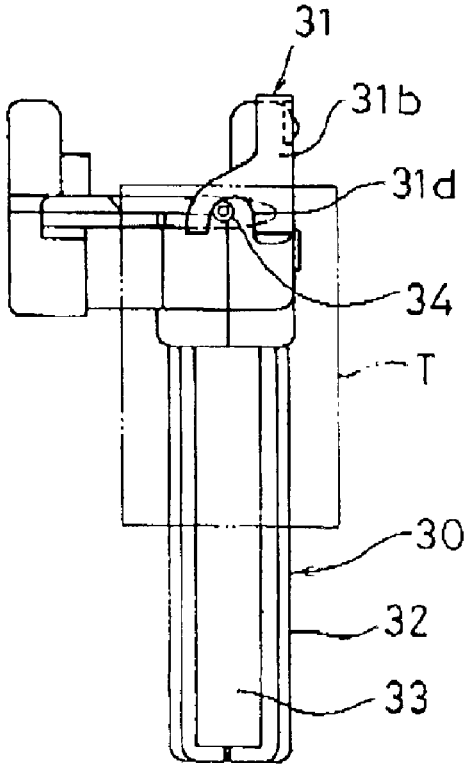
FIG. 14 is a drawing showing a front view of the tag attaching device using the tag holding means as shown in FIG. 13.

As shown in FIG. 9, although a tag holding means 31 as shown in FIG. 12 is provided at a front end portion of a main body 30, this tag holding means 31 is made of a thin metal plate or synthetic plastic material and it comprises a fixed side 31*a* and a tag holding side 31*b*.

And the tag holding side 31*b* has flexibility so that the tag T can be easily withdrawn therethrough.

Further, a stopper portion 31*c* is provided on a side edge portion of the tag holding side 31*b* in a direction perpendicular to the tag holding side 31*b*.

Figure 11:
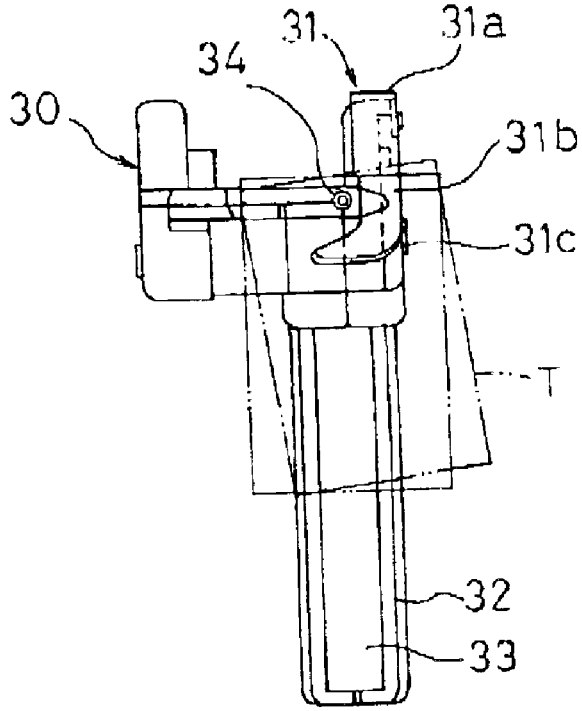
FIG. 11 is a drawing showing a front view of the tag-attaching device as shown in FIG. 9.

As shown in FIG. 11, by abutting the stopper portion 31*c* to the side surface of the main body 30, it is configured so that the tag holding side 31*b* is prevented from being deformed toward the hollow needle side.

Figure 10:
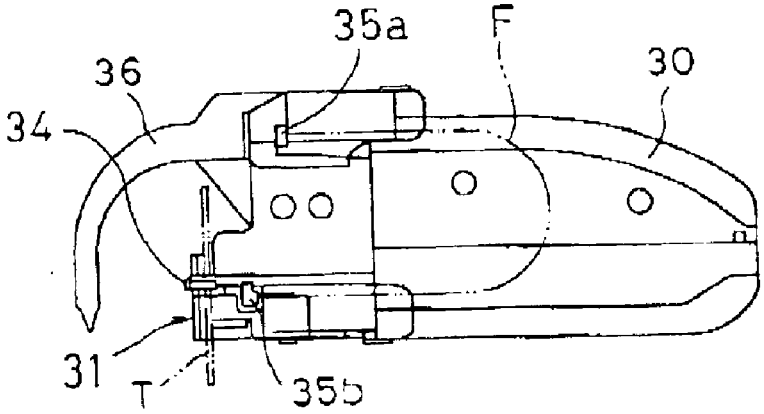
FIG. 10 is a drawing showing a plan view of the tag-attaching device as shown in FIG. 9.

By utilizing this tag attaching device, when a tag fastening means assembly, for examples a loop pin type tag fastening device, is mounted on a tag attaching device, in order to have both ends of the filament connected by contacting the contacting members provided both ends of the filament, a connecting bar for female portions is inserted into a supply hole 35*a*, while another connecting bar for male portions is inserted into a separate supply hole 35*b*, respectively, as shown in FIG. 10, while keeping the filament of the tag fastening means and existing between both male portion and female portion in a U-type configuration.

And as shown in FIG. 9, an operator first takes up an tag T with his finger and then hooks the tag T on the hollow needle 34 by deforming the lower end portion of the tag holding side 31*b* as shown at a position indicated by T1, and thereafter when the operator releases the tag T, as shown by a dotted line in a position T2, the tag T can be held between the front end portion of the main body 30 and the tag holding side 31*b*.

Then, when a lever 33 provided in front of a gripping portion 32 extended downwardly from the main body 30 and projected from the gripping portion 32 forwardly with a spring force, is driven as a firing operation, an internal mechanism, not shown, is activated so that the female portion can be sent to the most end portion of a guide member 36 through inside of the guide member 36, while the male portion can be pushed out forwardly through inside of the hollow needle 34 with a timing which is a little bit delayed from that of a movement of the female portion, so as to mate with the female portion waiting for the arrival of the male portion at the most end portion of the guide member 36 and thus both portions can be connected to each other.

As mentioned above, the since the tag holding side 31*b* of the tag holding means 31 has flexibility, the tag T can be naturally withdrawn from the hollow needle 34 by moving the tag T away from a surface of a good to which the tag T had been attached.

EXAMPLE 6

This example is an embodiment with some deformation derived from that as explained as the Example 5.

In the previous example as shown in FIG. 12, although he tag holding side 31*b* of the tag holding means 31 is made of a metal plate having an elasticity or a synthetic plastic, in this embodiment, the tag holding means 31 is formed to have an end portion comprising two separated end portions and thus the tag T can be stably held by the respective end portions at both side of the hollow needle 34.

As explained above, the tag attaching device of the present invention has a tag holding means provided at a place in the vicinity of a hollow needle or a member having the similar function to that of the hollow needle, which is projected from a front end portion of a main body of the tag attaching device which can penetrate a tag fastening means through a commodity good so as to attach a tag thereto or can attach tag fastening means comprising a filament and connection member provided both end of the filament made by synthetic plastic material to a commodity good, so that the tag can be attached to a good by making the filament in a loop like configuration.

Accordingly, the tag attaching device of the present invention can be operated with surely holding a tag and thus an operator can use it easily regardless the facing direction of a front end portion of the tag attaching device.

Further, in the present invention, even when a tag held by the tag attaching device had been contacted with a good during the tag attaching device is operated, since the tag is firmly held by the tag holding means, the tag never be fallen down and thus an operational efficiency of this device become extremely excellent.

Especially in the tag attaching device as shown in FIG. 1 or 4, at first, a tag is held by the tag holding means, and after that when the tag attaching operation to attach a tag to a commodity good, is carried out, the tag holding means is automatically opened and thus a tag can be efficiently attached to a good utilizing a tag fastening means.

In addition, as shown in FIG. 5, the tag holding means can be raised upwardly and be descended downwardly by manual operation, it is very effective when a number of tags to be attached to a good is small Further, in the tag attaching device as shown in FIG. 6, a tag can be attached to a good by automatically holding tags with the tag holding means as shown in FIG. 4.

In addition, in the tag attaching device as shown in FIG. 7, since the tag holding means is fixedly provided on the tag attaching device, the device has a simple construction and can be produced with a cheap cost.

And in the tag attaching device as shown in FIGS. 9 to 12, since a tag can be held automatically by a hollow needle by hooking a hole of a tag with the hollow needle projected from a front end portion of the tag attaching device with a short length, an operator can freely operate the tag attaching device with his single hand and thus he can use his opposite hand freely so that the operational efficiency of the tag attaching device of the present invention had been extremely improved comparing with that of a conventional one.

What is claimed is:

1. A tag attaching device comprising a main body, a grip portion extending downwardly from said main body and a lever projecting in front of said grip and swingably supported by said main body with a resilience force, an internal mechanism for driving a piston portion in response to a movement of said lever and a hollow needle provided at a front portion of said main body in front of said piston portion, so that a tag fastening means is shot out in accordance with a movement of said lever, wherein said tag attaching device is provided with a tag holding means to tentatively hold a tag at a front of said main body and said tag holding means is displaceable between a tag holding position and a tag receiving position, and further wherein said tag holding means comprises a first arm and a second arm each being pivotably supported on a side surface of a front portion of said main body, and a front plate connecting said first and second arms and which is positioned in front of said front portion of said main body, said tag holding means being configured so that when said tag holding means is in said tag holding position, said tag is held between said front plate and said front portion of said main body so that said tag does not drop out.

2. A tag attaching device according to claim 1, wherein said tag fastening means is either a fastening device comprising a filament, with a head portion provided at one end of said filament and a T-bar portion provided at another end thereof, at least said T-bar portion penetrating into a commodity so as to fix a tag supported by said filament on said commodity, or a connecting device comprising a filament, with a female portion provided at one end of said filament and a male portion provided at another end thereof, said filament supporting a tag thereon and penetrating a commodity whereafter said male portion and said female portion are connected to each other so that said filament is formed into a looped configuration holding said tag on said filament.

3. A tag attaching device according to claim 1, wherein said tag holding means is rotatably mounted on a front portion of said main body.

4. A tag attaching device according to claim 1, wherein said tag holding means is configured so that said tag holding means can stay at either one of said positions under the force of a spring member.

5. A tag attaching device according to claim 1, wherein said tag holding means is configured so as to be selectively disposed at either one of two positions consisting of a tag holding position and a tag receiving position by a connection between a spring means provided on a side surface of said main body and a cam portion provided on said second arm.

6. A tag attaching device according to claim 1, wherein said tag being supported by a hollow needle through a hole provided on said tag before said tag fastening means is shot by said tag attaching device.

7. A tag attaching device according to claim 6, wherein said tag holding means is configured so that when said tag is withdrawn from said hollow needle, a front plate is automatically lifted up by a movement of said tag causing said tag holding means to be set in said tag receiving position.

8. A tag attaching device according to claim 7, wherein said tag holding means is configured so that when said tag is held on said hollow needle through said hole provided on said tag and said front plate of said tag holding means is in said tag receiving position, said tag pushes an arm so as return said tag holding means to said tag holding position.

9. A tag attaching device according to claim 8, wherein said tag holding means is configured so as to be selectively disposed in either one of two positions consisting of a tag holding position and a tag receiving position by a connection between a spring means provided on a side surface of said main body and a cam portion provided on an arm, and said tag holding means is controlled so that when said tag is withdrawn from said hollow needle, said front plate is pressured by a movement of said tag whereby said tag holding means is raised to said tag receiving position, while said tag holding means being moved to said tag holding position by said arm.

10. A tag attaching device according to claim 1, wherein said tag holding means comprises first and second arms and a front plate further provided with a spring means so as to return said tag holding means from said tag receiving position to said tag holding position.

11. A tag attaching device according to claim 1, wherein said tag holding means is disposed in a position in the vicinity of a hollow needle provided on a front end portion of said main body, said tag holding means having elasticity, and said tag holding means is configured so that said tag is inserted into said front end portion of said main body whereby said tag is hooked on said hollow needle via a hole provided on said tag, during a time when said tag holding means is deformed, so as to hold said tag by said tag holding means, and further when said tag fastening device is about to be removed from a commodity and said tag attaching device, said tag is withdrawn from said tag attaching device with said tag deforming said tag holding means.

* * * * *